US005161961A

United States Patent [19]

Zheng

[11] Patent Number: 5,161,961

[45] Date of Patent: Nov. 10, 1992

[54] GEAR PUMP WITH COUNTERBALANCED RADIAL FORCES AND TWO PIECE RADIAL SEALS

[76] Inventor: Yue Zheng, Room 105, Building 15 (old), Beicun, Nankai University, Tianjin, China

[21] Appl. No.: 659,250

[22] Filed: Feb. 20, 1991

[30] Foreign Application Priority Data

Feb. 21, 1990 [CN] China ..... 90100918

[51] Int. Cl.[5] ..... F04C 2/10; F04C 2/18; F04C 15/00

[52] U.S. Cl. ..... 418/20; 418/21; 418/134; 418/196; 418/140

[58] Field of Search ..... 418/1, 20, 21, 131, 418/134, 140, 144, 196, 165, 61.1

[56] References Cited

U.S. PATENT DOCUMENTS

| | | | |
|---|---|---|---|
| 2,801,593 | 8/1957 | Mosbacher | 418/196 |
| 3,225,699 | 12/1965 | Wiggermann | 418/20 |
| 3,375,661 | 4/1968 | Shachter | 418/20 |
| 3,588,295 | 6/1971 | Burk | 418/21 |
| 3,873,252 | 3/1975 | Motomura et al. | 418/196 |
| 4,674,615 | 6/1987 | Snyder | 418/21 |
| 4,780,070 | 10/1988 | Hertell | 418/61.1 |
| 4,872,536 | 10/1986 | Yue | 418/21 |

FOREIGN PATENT DOCUMENTS

| | | | |
|---|---|---|---|
| 3241430 | 10/1983 | Fed. Rep. of Germany . | |
| 57-52694 | 3/1982 | Japan . | |
| 59-193788 | 11/1982 | Japan . | |
| 69679 | 10/1945 | Norway | 418/21 |
| 8510074 | 1/1985 | Switzerland . | |
| 1105690 | 7/1984 | U.S.S.R. . | |
| 1126718 | 11/1984 | U.S.S.R. | 418/21 |
| 1566084 | 5/1990 | U.S.S.R. | 418/21 |

OTHER PUBLICATIONS

PCT/AU85/00212; WO 86/02126; Applicant Hooker, Sydney, Graham International Publicat Date: Apr. 10, 1986, abstract only.

*Primary Examiner*—Richard A. Bertsch
*Assistant Examiner*—David L. Cavanaugh
*Attorney, Agent, or Firm*—Longacre & White

[57] ABSTRACT

By using multiple external gears and internal gears, which are engaged with each other, and multiple radial sealing elements and axial sealing elements, a pump or motor, which includes multiple equivalent pumps or motors, is made. Each gear included in thus made gear pump or motor is radially hydraulically counterbalanced, even completely hydro-mechanically counterbalanced, loads on bearings being able to become zero. Axial gaps and radial gaps both have been compensated. The pump or motor can stagelessly vary its output. Accordingly, a gear pump or motor with constant output or stagelessly variable output, as well as a relevant stageless hydraulic speed variator, can be made, which will have lower production cost, higher transmission efficiency and higher power density.

11 Claims, 3 Drawing Sheets

GEAR PUMP WITH COUNTERBALANCED RADIAL FORCES AND TWO PIECE RADIAL SEALS

The present invention relates to a gear pump or motor, especially a planetary gear pump. U.S. Pat. No. 4872536 and Chinese patent No. 86106471 describe this type of gear pump, whose output can be stagelessly variable and which has a lower cost of production. However, the total efficiency of gear type pumps is not as high as with other types. The limitations upon increasing the total efficiency and power density of a gear pump is mainly due to excessive radial loads on bearings, shorten the life of the bearings and permit deflection of the shafts. For this reason, it is difficult to increase the total efficiency of a gear pump.

The object of the present invention is to counterbalance the radial forces on the gears in a gear pump or motor. A planetary gear pump fabricated according to the instant invention overcomes the above-mentioned difficulty and the total efficiency is increased.

According to the present invention, by engaging multiple gears and using sideplates and radial sealing blocks, substantially equal-spaced hydraulic high pressure regions are formed around gear shafts in the gear pump or motor which counterbalance the radial forces on the gears. The spacing, shapes and wrap angles with respect to the gears of the hydraulic high pressure regions are designed such that the resultant of the hydraulic forces from the hydraulic high pressure regions counterbalance other radial forces on the gears, such as those caused by gear engagements and radial loads.

According to the present invention the gear pump or motor comprises a casing, more than two gears, axial sealing sideplates, sealing elements and more than one radial sealing block. The radial sealing blocks and the gears, together with above-mentioned axial sealing sideplates, form the hydraulic high pressure regions. The sealing elements and the gears separate high and low hydraulic pressure regions. Among the gears engaged with each other to cause high hydraulic pressure, there is at least one gear that has hydraulic high pressure regions around its tooth top circumferential surface that are substantially equal-spaced to make the radial forces on the gear mutually counterbalanced. The disposition of these hydraulic high pressure regions relative to the gear and the sizes of their wrap angles can be adjusted to achieve the radial hydraulic counterbalance of the gear. If there are other larger mechanical forces, the hydraulic forces caused by the high pressure regions may be left uncounterbalanced such that the resultant of the hydraulic forces counteracts the other mechanical forces on the gears, gear shafts and bearings.

The present invention also adopts radial and axial gap compensation devices, thus further increasing the total efficiency of the gear pump.

According to the present invention, the gears generating high hydraulic pressure include at least one internal gear, a sun gear and more than one planet gear in planetary engagement. There is at least one radial sealing block consisting of a pair of fitted half-blocks. The two radial sealing half-blocks are fitted fluid-tightly against the tooth tops of a pair of engaged gears.

Each of the radial sealing half-blocks can slightly rotate around its own mandrel and a bushing made of flexible material mounting the mandrel enables the radial sealing half-block to be slightly translational. The mandrel of each radial sealing half-block can be attached to an axial sealing sideplate, while one end of the radial sealing half-block fits tightly against the corresponding axial sealing sideplate. Between the two radial sealing half-blocks there is a wedge with its larger thickness at its back facing the high pressure region. Thus, by enlarging the thickness of the wedge-back facing the high pressure region, thereby enlarging the distance between two mandrels of the radial sealing half-blocks, the contacting pressure of the radial sealing half-blocks with the gear teeth can be increased to accomplish radial gap compensation for different pressures.

The axial sealing sideplates comprise a fixed sideplate and an axially slidable sideplate. The fixed sideplate is attached to the pump casing. The axial sealing sideplates are fluid-tightly and rotatably provided with the ring gears with internal teeth and the ring with external teeth. The ring with external teeth and the ring gears mounted on the axial sealing sideplates are fitted tightly against the corresponding sun gear, planet gears and the internal gear in the pump such that they can rotate together with the fitted gears. The rings with external teeth and the ring gears mounted on the slidable sideplate can also move axially together with the slidable sideplate. In the tooth gaps existing among the ring with external teeth and the ring gears mounted on the axial sealing sideplates and their fitted gears, sealing rings made of flexible material and being tooth-shaped are inserted.

Among the pairs of radial sealing half-blocks, the half-blocks furtherest from the corresponding planet gears are the slidable radial sealing half-blocks. The ends on one side of the slidable radially sealing half-blocks being fitted against the slidable sideplate and the ends on the other side being able to extend through corresponding holes in the fixed sideplate and can move axially together with the slidable sideplate. The radial sealing half-blocks nearest to the corresponding planet gears are fixed radial sealing half-blocks. The ends on one side of the fixed radial sealing half-block being supported on the fixed sideplate and the ends on the other side extending through corresponding holes in the slidable sideplate.

When the slidable sideplate slides to adjust the distance between the pair of sideplates, the length of engagement of the planet gears with the sun gear and the internal gear vary such that the pump or motor output per revolution is stagelessly variable.

The slidable radial sealing half-blocks with their ends on one side placed against the slidable sideplate and the fixed radial sealing half-blocks with their ends on one side supported on the fixed sideplate can both be attached at their respective other sides to individual balancing endplates for reducing the deformation caused by the hydraulic pressure on the two kinds of radial sealing half-blocks and for enabling the hydraulic forces on the radial sealing half-blocks to be mutually counteracted whereby the slidable sideplate may slide easily.

Axial gap compensating devices are provided which have a flexible element (such as a spring) and a thrust bearing. The flexible element is placed between the thrust bearing for a gear shaft and the corresponding sideplate to press the gear end towards the corresponding sideplate, thus compensating for the axial gap therebetween.

Since the present invention can nearly eliminate the loads on gear shafts and bearings on a gear pump or motor with either variable or constant output, the mechanical loss can be decreased by one or two magnitudes. Further, because of compensation for radial and axial gaps, the volume efficiency can be increased. By disposing multiple equivalent pumps and increasing the working pressure permits the output to be decreased and the use of gears with smaller modules. Therefore, the present invention can increase the total efficiency of a gear pump (motor), with either variable or constant output, to 95%-97%, increase the power density by 2-4 times that of an ordinary configuration, reduce the noise and output fluctuation to a large extent, reduce the production cost and form a hydraulic speed variator with excellent performance.

The planetary gear pump according the present invention is described in detail in combination with the attached figures.

Figure 3A:
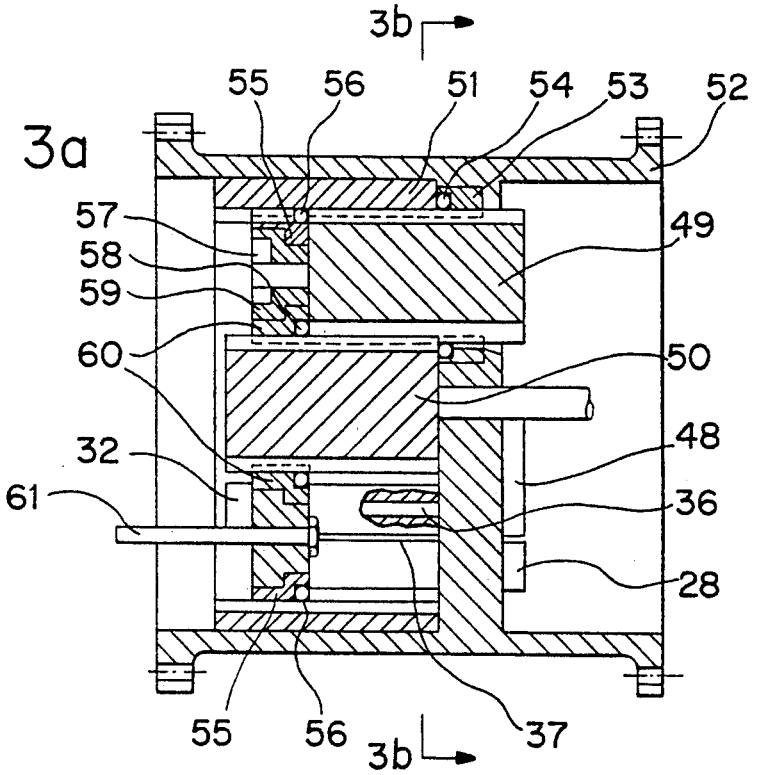
Figure 3B:
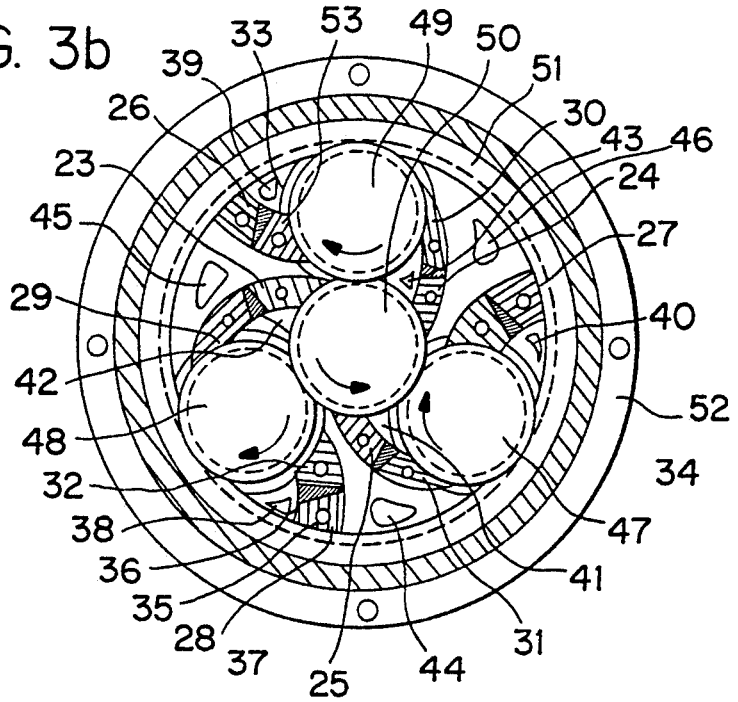

FIG. 3*a* is a longitudinal sectional view of the planetary gear pump of the embodiment according to the present invention;

FIG. 3*b* is a cross-sectional view taken along line 3*b*-3*b* in FIG. 3*a*.

Figure 3C:
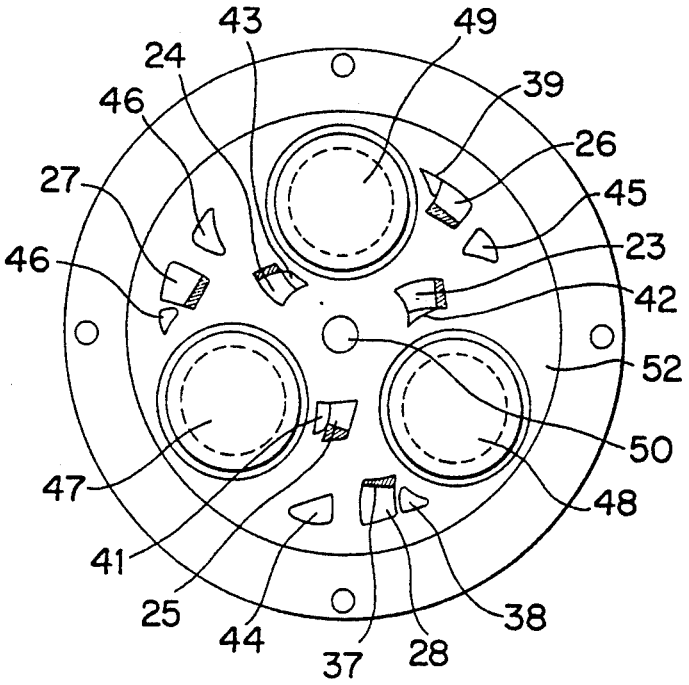

FIG. 3*c* is a right side view of FIG. 3*a*.

Figure 3D:
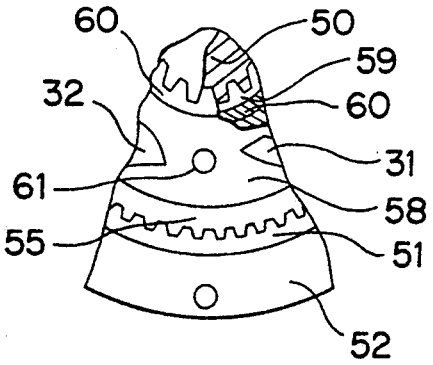

FIG. 3*d* is a lower partial view from the left side view of FIG. 3*a*.

Figure 3E:
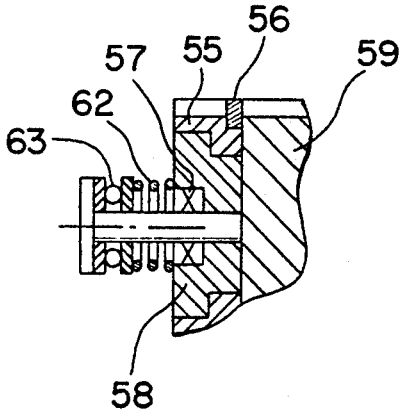

FIG. 3*e* shows the way of compensating for the axial gaps.

Figure 1:
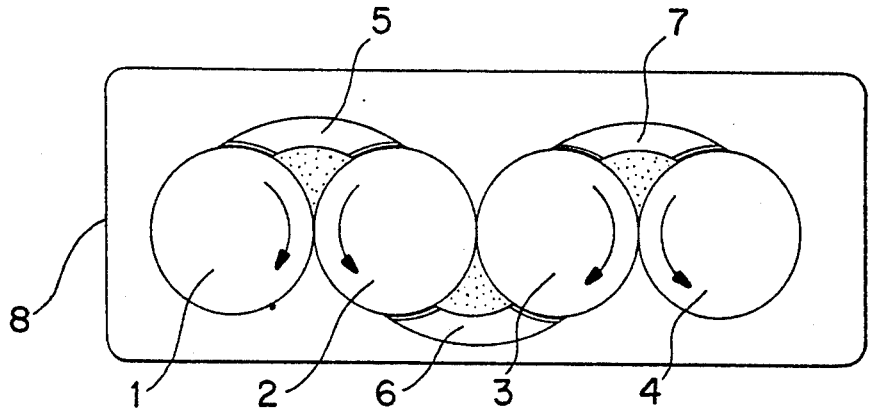
FIG. 1 is a schematic drawing of the counterbalancing gear pump.

As shown in FIG. 1, numerals 1-4 represent four gears engaged with each other. Radial sealing is accomplished by radial sealing blocks 5-7, both ends of each block being fluid-tightly fitted against tooth tops. According to the rotational directions of the gears shown in the figure, the spotted regions are hydraulic high pressure regions. The high and low pressure fluids both flow in and out through the axial openings in the sideplates (not shown in the figure) which complete the sealing, with the result that three equivalent external gear pumps are formed. Numeral 8 represents the casing. For gears 2 and 3, the high pressure regions are equal-spaced around the axis of the gears and the hydraulic forces which act on the gear are counteracted by each other. Gears 1 and 4 are also under the action of unidirectional hydraulic pressure. Obviously, the more gears engaged in series, the lower the total average radial pressure acting on the set of gears. Therefore, by further adoption of an internal gear to make the engaged gear system closed, we can obtain a gear pump with its radial pressure completely counterbalanced.

Figure 2:
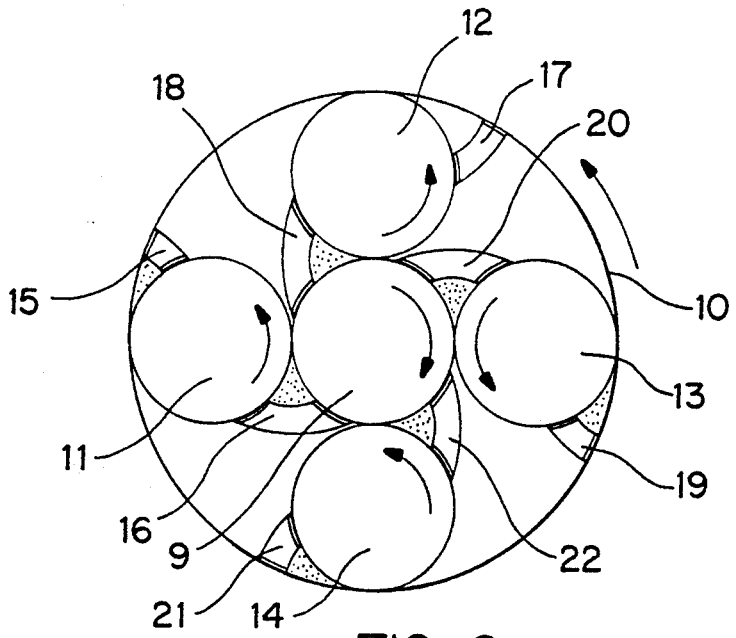
FIG. 2 is a schematic drawing of the embodiment according to the present invention. It shows eight high pressure regions are formed by eight radial sealing blocks and the internal gear and planet gears, thus making eight equivalent pumps.

As shown in FIG. 2, numerals 10 and 9 represent an internal gear and an external gear or a sun gear, respectively. Numerals 11-14 represent four equally spaced external gears or planet gears. Numerals 15-22 represent eight radial sealing blocks which form eight equivalent pumps together with the gears. According to the rotational directions shown in the figure, the spotted regions are high pressure regions. Sideplates which are provided with openings for high and low pressure fluid have not been shown in this figure. Since the high pressure acting on the gear teeth of every gear is distributed uniformly around the gear axis, every gear is radially counterbalanced under its hydraulic forces. By adjusting the disposition of the high pressure regions at the tooth top circumferential surfaces and the sizes of their wrap angles with respect to the gears, an imbalance of the radial hydraulic forces can be achieved purposely to enable the resultant of the radial hydraulic forces, which have a certain direction and magnitude, to counteract mechanical forces (such as engaging forces, radial thrusts and so on) acting on the gears, shafts and bearings, thus eliminating radial loads on bearings. Analyzing the direction and magnitude of the radial resultant produced on gears by the hydraulic pressure of the high pressure regions with certain disposition and wrap angles will not be described here, because it is conventionally known. The number of the planet gears depends on both necessity and possibility. When this number is n, the number of equivalent pumps is 2n. The power density is thus increased to a large extent.

A planet gear may have a fixed axis. And it may also have a movable axis as a planetary mechanical transmission does; that is, the axis of a planet gear travels around the axis of a sun gear. In the instant invention, all the radial sealing blocks, together with the axis of all the planet gears, travel with the planetary carrier; that is, each radial sealing block rotates about the axis of the sun gear, while its relative position with respect to the axis of the planet gear remains unchanged. The axial sealing sideplates also rotate with the planetary carrier. The fluid inlets and outlets, which are provided on the two sideplates respectively, are each connected with respective fluid-gathering chambers. The high and low pressure fluid-gathering chambers, acting as the inlet and outlet of the pump, are connected with external fluid passages. Varying the relative rotational speeds among the sun gear, planetary carrier and internal gear, the output of the pump may be changed. Thus, the pump can be used for stageless speed variation, mechanical differential and deceleration. Therefore, when the fluid passage of this kind of counterbalancing planetary gear pump (or motor) with movable axis may be connected with the fluid passage of another motor (or pump) having the same or different configuration and, at the same time, one or two of the sun gear, planetary carrier and internal gear have direct or indirect mechanical coupling with the other motor (pump) system. A hydro-mechanical bypass or closed transmission may be included to accomplish more complicated transmissions.

Pressure on the radial sealing blocks from the high pressure regions pushes the radial sealing blocks away from the gears, for radial sealing gap compensation, as shown by FIG. 3*b*. External gear 50 and internal gear 51 rotate in the directions shown in the figure. The pressure in the high pressure region, i.e. at fluid outlets 38-43, tends to push the radial sealing block away from the gear. Each radial sealing block comprises two radial sealing half-blocks 26-28 and 32-34. The two half-blocks are axially fluid-tightly fitted against each other through a wedge 37 and at the same time fluid-tightly fitted against the tooth tops of a pair of engaged gears. The half-blocks rotate slightly around their mandrels 35-36 with the two ends of each mandrel supported on the two sideplates. Wedge 37 is made of flexible material (e.g. NYLON) which wedges between the half-blocks 28 and 32 under the pressure from a high pressure region. The half-blocks 28 and 32 are pressed against the gears to accomplish radial sealing gap compensation. Mandrels 35 and 36 ma be provided with flexible bushings (not shown in the figure). The magnitude of the contact pressure between the radial sealing half-blocks and the gears can be varied by adjusting the locations of the two mandrels and the distance between them as well as the thickness of the wedge which is acted upon by the high pressure fluid. A larger distance or a greater thickness increase the contact pressure between the radial sealing half-blocks and the gears. In the case that maximum pump performance is unnecessary, the wedge and variable mandrels may be eliminated. To achieve better sealing, section shapes other than a wedge are anticipated.

The counterbalancing gear pump can also accomplish stageless variation of the pump output per revolution by varying the axial length of engagement between gears to vary the working volume and simultaneously ensure proper sealing. A basic configuration is shown in FIG. 3*a* to FIG. 3*e*. To describe the invention more clearly, some secondary details of the figures have been omitted, e.g. radial sealing half-block 25 has been removed from FIG. 3*a*. The twelve radial sealing half-blocks 23–34 make six sets of radial sealing blocks, each set including two radial sealing half-blocks, two mandrels 35 and 36 which support the radial sealing half-blocks, and a wedge 37. Each mandrel is supported on two sideplates 58 and 52. The half-blocks, together with the gears contacted, complete the radial sealing of the high pressure regions at six fluid outlets 38–43. The axial sealing on the left-hand side (FIG. 3*a*) is formed by slidable sideplate 58, ring with external teeth 55 fluid-tightly rotatably provided on the outer periphery of sideplate 58, and ring gear 60 fluid-tightly rotatably provided on the inner periphery of sideplate 58. Ring with external teeth 55 and ring gear 60 are fitted tightly against internal gear 51 and sun gear 50, respectively, registering with the convexities and concavities of the gear shapes and are rotatable therewith. Tooth-shaped sealing rings 56 and 59 are made of flexible material and inserted into the gear gaps. When the slidable sideplate 58 slides axially, 55, 60 56, and 59 move accordingly with the slidable sideplate 58 and remain rotatable with respect thereto, thus axially sealing the slidable sideplate 58 with respect to sideplate 52. The axial sealing on the right-hand side (FIG. 3*a*) is formed by the fixed sideplate 52 integrated with the casing. The sideplate 52 supports three ring gears 53 fluid-tightly and rotatably, their internal teeth being fitted tightly on the external teeth of planet gears 49 (matching 53), 48 and 47. At tooth gaps, the tooth-shaped sealing rings 54, which are made of flexible material, are provided. Axially slidable planet gears 47–49 remain engaged with axially fixed sun gear 50 and internal gear 51. The left end (FIG. 3*a*) of each planet gear is supported by a bearing 57 (total of 3) on the slidable sideplate 58; the right end of the planet gears is supported by the ring gears 53 (total of 3) on the fixed sideplate 52, to enable the planet gears to slide axially, together with the slidable sideplate. The set of radial sealing half-blocks 23–28, those which are farther away from the planet gears, have their respective mandrel 35 mounted on the slideable sideplate 58 and slidably extends out through a hole in the fixed sideplate 52. These radial sealing half-blocks which can axially move with the slideable sideplate 58 are called slidable radial sealing half-blocks. The set of radial sealing half-blocks 29–34, those which are nearer to the planet gears, have their respective mandrel 36 mounted on the fixed sideplate 52 and slidably extends out through a hole in the slidable sideplate 58. These are called fixed radial sealing half-blocks. A ring of flexible material may be inserted between each radial sealing half-block and the corresponding hole in the respective sideplate to ensure sealing. A wedge 37 may be fixed on a slidable radial sealing half-block 28 and move together with it (as shown in FIG. 3*c*). However the wedge may also be integrated with a fixed radial sealing half-block. The rings of flexible material inserted into the holes of the side-plate has enough elasticity to permit slight rotation of the respective radial sealing half-block. Thus, when the slidable sideplate slides towards the fixed sideplate, complete sealing is ensured. The pump output per revolution decreases stagelessly as the axial distance between the sideplates (i.e. the engaging length of the gears) decreases. Put another way, the pump output per revolution changes from zero to its maximum as the distance between two sideplates changes from zero to its maximum.

The fluid inlets at the low pressure regions 44–46 and the fluid outlets 38–43, are all formed in the fixed sideplate 52. The fluid inlets and outlets convey fluid to the related ring gears. There can be various types of the fluid inlets, such as a round one which is inner-threaded to allow a pipe to be screwed in. Rod 61 may be attached to the slidable sideplate 58 for controlling the mechanism and is used to push or pull the slidable sideplate 58 to make it slide axially as well as prevent rotating of the slidable sideplate around its axis. More than one rod may be provided. Because of the pivoting of the radial sealing half-blocks under the action of hydraulic pressure, the friction resistance between the radial sealing half-blocks and the corresponding sideplate holes can be large enough to make the axial sliding difficult. To avoid this, the end of each slidable radial sealing half-block, which extends through the fixed sideplate 52, may be attached to a counterbalancing end plate, and the end of each fixed radial sealing half-block, which extends through the slidable sideplate 58, may be attached to another counterbalancing endplate. The counterbalancing end plates may be slidably supported on the casing and provided with holes allowing an input shaft to pass there through. This enables the hydraulic forces on the radial sealing half-blocks to be basically counteracted by means of the endplates. Thus, the deformation of the radial sealing half-blocks is decreased and the friction resistance between the radial sealing half-blocks and the holes becomes very small, with the result that the sliding becomes easier. The length of the radial sealing half-block is selected to ensure that the counterbalancing endplates do not obstruct the sliding of the two sideplates at their maximum separation.

To further increase the efficiency and the life of the counterbalancing gear pump, axial gap compensation is needed. This can be done by using flexible elements such as springs to press gears towards sideplates. An axial gap compensation device is shown in FIG. 3*e*. A small thrust bearing 63 is provided at the shaft end of planet gear 49; a compression spring 62 is provided between bearing 63 and slidable sideplate 58. By pressing the left end of planet gear 49 towards sideplate 58 to seal against sideplate 58, the axial gap can be minimized under heat and wear conditions. Also anticipated by the instant invention is a variable counterbalancing gear pump which can be formed with axially fixed planet gears with axially moving internal and sun gears.

The present invention describing a variable or invariable output counterbalancing gear pump can also be used as a gear motor. The variable output counterbalancing gear pump or motor may also function like a constant output pump (motor), and may be so made that the planetary carrier, together with the planet gear axes and all the radial sealing half-blocks, rotates about the sun gear axis. In the latter case, the fixed sideplate will not be integral with the casing but rotatable together with the planetary carrier. Other types of the pumps (motors) consisting of more than two engaged gears, as for example shown in FIG. 1, which is an external gear pump with multiple gears, or a multiple planet gear pump without any sun gear, can also be made with stagelessly variable output; but the effects will not be better than that of the pump type shown in FIG. 2.

I claim:

1. A process counterbalancing radial forces in a gear pump or motor, comprising: multiple gears engaged with each other; sideplates, radial sealing blocks and said multiple gears delimit hydraulic high pressure regions substantially equally-spaced around the axis of each of said multiple gears to make the radial forces on each of said multiple gears counterbalanced; whereby the disposition, shapes and wrap angles with respect to said multiple gears of the hydraulic high pressure regions are adapted such that a resultant of hydraulic forces from the hydraulic high pressure regions counterbalances the radial forces on said multiple gears.

2. A gear pump or motor, comprising: a casing, at least three gears, axial sealing sideplates, sealing means for sealing said gears with respect to said sideplates, and a plurality of radial sealing blocks; said radial sealing blocks, the gears and said sideplates delimit a plurality of hydraulic high pressure regions; whereby said gears are engaged with each other to cause said hydraulic high pressure regions at tooth top circumferential surfaces of each of said gears, said hydraulic high pressure regions are substantially equally-spaced around said tooth top circumferential surfaces to make radial forces on the gears mutually counterbalanced; whereby the disposition of the hydraulic high pressure regions relative to the gear and the sizes of their wrap angles with respect to said gears are adapted to be adjusted to counterbalance other mechanical forces on said gears, gear shafts and bearings.

3. The gear pump or motor as set forth in claim 2, wherein the gears engaged to cause hydraulic high pressure comprise at least one internal gear, a sun gear and a plurality of planet gears in planetary engagement with one another, and said plurality of radial sealing blocks comprise a pair of radial sealing half-blocks in fluid-tight contact with one another; each of said two radial sealing half-blocks are in fluid-tight contact with one of the tooth top circumferential surfaces of a pair of engaged gears respectively.

4. The gear pump or motor as set forth in claim 3, wherein each of the radial sealing half-blocks is adapted to slightly rotate around a corresponding mandrel, each of said mandrels are mounted on one of said sideplates with a bushing made of flexible material adapted to enable the radial sealing half-block to translate slightly; whereby one end of the radial sealing half-block is mounted in fluid tight contact against said one sideplate; between said two radial sealing half-blocks is a wedge with larger thickness at its back facing one of said hydraulic high pressure regions, whereby an enlarged thickness of the back of said wedge and a greater distance between aid corresponding two mandrels of the radial sealing half-blocks increases the contact pressure of the radial sealing half-blocks on the tooth top circumferential surfaces of said gears to accomplish radial gap compensation for different pressures.

5. The gear pump or motor as set forth in claim 3, wherein said axial sealing sideplate comprise an axially slidable sideplate and a fixed sideplate attached to the casing; mounted fluid-tightly and rotatably on said axial sealing sideplates are a plurality of ring gears with internal teeth and a ring with external teeth; each of said plurality of ring gears tightly encompass one of the corresponding sun gear and planet gears, and the ring with external teeth tightly engages the internal gear; the ring with external teeth and the ring gear encompassing said sun gear are mounted on the slidable sideplate and move axially therewith; in tooth gaps at the interface between the ring with external teeth and the ring gear encompassing said sun gear, sealing rings made of flexible material and being tooth-shaped are adapted to be inserted in said tooth gaps.

6. The gear pump or motor as set forth in claim 5, wherein said radial sealing half-blocks which are further from the corresponding planet gears are slidable radial sealing half-blocks, a first end face on each of said slidable radial sealing half-blocks sealingly contacting said slidable side plate and a second end face on each of said slidable radial sealing half-blocks extending through corresponding holes in the fixed sideplate, and said slidable radial sealing half-blocks move axially together with the slidable sideplate; said radial sealing half-blocks which are nearer to the corresponding planet gears are fixed radial sealing half-blocks, a first end face on each of said fixed radial sealing half-block sealingly contacting the fixed sideplate and a second end face on each of said fixed radial sealingly half-blocks extending through corresponding holes in the slidable sideplate.

7. The gear pump or motor as set forth in claim 6, wherein the slidable sideplate is adapted to slide with respect to the fixed sideplate to vary the distance between the pair of sideplates, thereby varying the length of engagement between the planet gears with the sun gear as well as the internal gear whereby the output per revolution of the pump or motor is stagelessly variable.

8. The gear pump or motor as set forth in claim 7, wherein said slidable radial sealing half-blocks and said fixed radial sealing half-blocks are attached at their respective second ends to individual balancing end plates, thereby reducing deformations caused by the hydraulic high pressure regions on said radial sealing half-blocks and adapted to mutually counterbalance hydraulic forces on the radial sealing half-blocks to make the slidable sideplate slide easily.

9. The gear pump or motor as set forth in claim 2, further comprising axial gap compensation devices having a resilient element and a thrust bearing for each of the gear shafts; resilient element is between said thrust bearing and the corresponding sideplate and is adapted to press the gear towards the corresponding sideplate, thus compensating for any axial gap at an interface therebetween.

10. The gear pump or motor as set forth in claim 3, further comprising a planetary carrier carrying axes of the planet gears, the radial sealing half-blocks, the two sideplates as well as fluid inlets and outlets in the sideplates, about the axis of the sun gear, whereby the relative positions of the radial sealing half-blocks with respect to the axes of the planet gears remain unchanged; fluid in the gear pump or motor is adapted to flow between low and high pressure fluid gathering chambers connected with the rotating fluid inlets and outlets and with external fluid passages.

11. The gear pump or motor as set forth in claim 10, wherein at least one of said external fluid passages is connected with a second external fluid passage of a second motor or pump system, whereby one of the sun gear, planetary carrier and internal gear of the gear pump or motor is adapted to be mechanically coupled with the second motor or pump including a hydro-mechanical bypass.

* * * * *